United States Patent [19]

Sakino

[11] Patent Number: 4,623,771

[45] Date of Patent: Nov. 18, 1986

[54] HIGH-VOLTAGE TRANSFORMER COOLING ASSEMBLY OF MICROWAVE OVEN

[75] Inventor: Tadashi Sakino, Yao, Japan

[73] Assignee: Sharp Kabushiki Kaisha, Osaka, Japan

[21] Appl. No.: 732,285

[22] Filed: May 9, 1985

[30] Foreign Application Priority Data

Jun. 19, 1984 [JP] Japan ..... 59-92711[U]

[51] Int. Cl.[4] ..... H05B 6/64

[52] U.S. Cl. ..... 219/10.55 R; 219/10.55 B

[58] Field of Search ..... 219/10.55 R, 10.55 B, 219/400; 126/198; 361/384, 383

[56] References Cited

U.S. PATENT DOCUMENTS

| | | | |
|---|---|---|---|
| 3,654,417 | 4/1972 | Javes et al. | 219/10.55 R |
| 4,123,643 | 10/1978 | Burke | 219/10.55 R |
| 4,221,949 | 9/1980 | Minakawa | 219/10.55 R X |
| 4,327,274 | 4/1982 | White et al. | 219/10.55 R |

FOREIGN PATENT DOCUMENTS

| | | | |
|---|---|---|---|
| 54-10457 | 1/1979 | Japan | 219/10.55 R |

*Primary Examiner*—Philip H. Leung

*Attorney, Agent, or Firm*—Birch, Stewart, Kolasch & Birch

[57] ABSTRACT

The preferred embodiment hereby discloses a unique configuration for a microwave oven to effect the efficient cooling of both the high-voltage transformer and the magnetron with a blower, in which the high-voltage transformer is secured to the air-intake port of the blower, and the magnetron and the exhaust outlet are aligned parallel to each other on the upper sides of the blower unit, thus effectively minimizing resistance to air ventilation through the blower unit, and, as a result, significantly improving the operative efficiency of the blower unit and the actual cooling effect on the high-voltage transformer. In addition, this improved cooling system offers great advantages with the possibility of savings in production costs through the realizable reduction in coil diameter of a high-voltage transformer due to the improved temperature control of the cells of such high-voltage transformers.

3 Claims, 3 Drawing Figures

PRIOR ART

HIGH-VOLTAGE TRANSFORMER COOLING ASSEMBLY OF MICROWAVE OVEN

BACKGROUND OF THE INVENTION

The present invention relates to a high-frequency heating device, more particularly, to the improvement of the cooling device for high-voltage transformers.

Conventionally, any high-frequency heating device for microwave ovens is provided with a cooling fan for cooling the internal electric parts such as the high-voltage transformer feeding high voltages to the magnetron that oscillates high frequencies. FIG. 3 is a cross sectional view showing a typical cooling device applied to the cooling of a conventional high-frequency heating device. Reference number 1 indicates the machine chamber provided in the lateral part of the cooking chamber. Reference number 2 indicates the high-voltage transformer mounted on the bottom plate 3. Reference numbers 4 and 4 indicate the air-intake slits. Reference number 5 indicates the air blower that feeds external air through the air-intake slits 4 and 4 to cool the high-voltage transformer 2 and blows air against the magnetron 6 for cooling. Reference number 7 indicates the exhaust outlet externally discharging air after cooling both the high-voltage transformer 2 and the magnetron 6. Reference number 8 indicates the control panel provided on the front surface of the microwave oven 9. The cooling device provides such a blower unit 5 having its air-intake direction deviated from that of the air-intake slits 4 and 4, while the air passage between both bends like the symbol. In the conventional cooling device mentioned above, since air flows in series while cooling both the high-voltage transformer 2 and the magnetron 6, the effect of ventilation is significantly disturbed, thus causing the blower unit 5 to lose some of its air blowing effect, and, as a result, such a conventional cooling device cannot effectively cool the high-voltage transformer 2. When using a cooling device such as shown in FIG. 3, the blower unit 5 is operated in such a condition that the air-blowing efficiency constantly remains poor, and yet, external air absorbed from the air-intake slit 4 in front of the high-voltage transformer 2 cannot effectively remove heat from this transformer. Consequently, the high-voltage transformer cannot always be cooled sufficiently, thus making it necessary to use such coils having a substantial diameter in order to properly keep the coil temperature below a specific level, and, as a result, conventional microwave ovens are obliged to use expensive high-voltage transformers as high-frequency heating devices.

OBJECTS AND SUMMARY OF THE INVENTION

In the light of the disadvantages mentioned above, the present invention aims at providing a unique configuration of a system needed for cooling both the high-voltage transformer and the magnetron using a blower, in which the high-voltage transformer is set in position on the air-intake port of the blower, while positioning both the magnetron and the exhaust outlet in parallel on the upper side of the blower unit, thus making it possible to securely improved both the operative efficiency of the blower itself and the effect of cooling the high-voltage transformer as well. The configuration embodied by the present invention also makes it possible to use a coil having a thinner diameter for a high-voltage transformer, eventually resulting in savings in total production costs.

DETAILED DESCRIPTION OF THE PREFERRED EMBODIMENT

Figure 1:
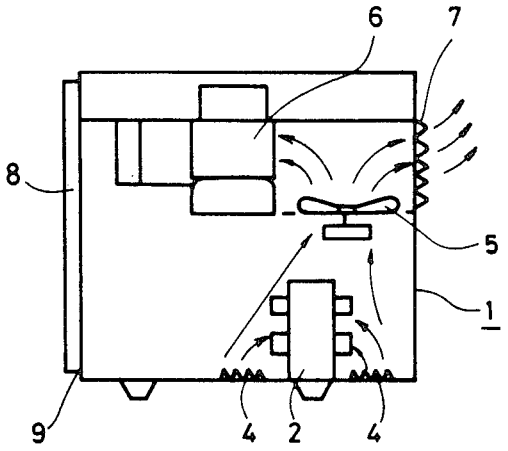
FIG. 1 is a cross sectional view showing the high-frequency heater cooling device of a microwave oven of the preferred embodiment of the present invention.
Figure 2:
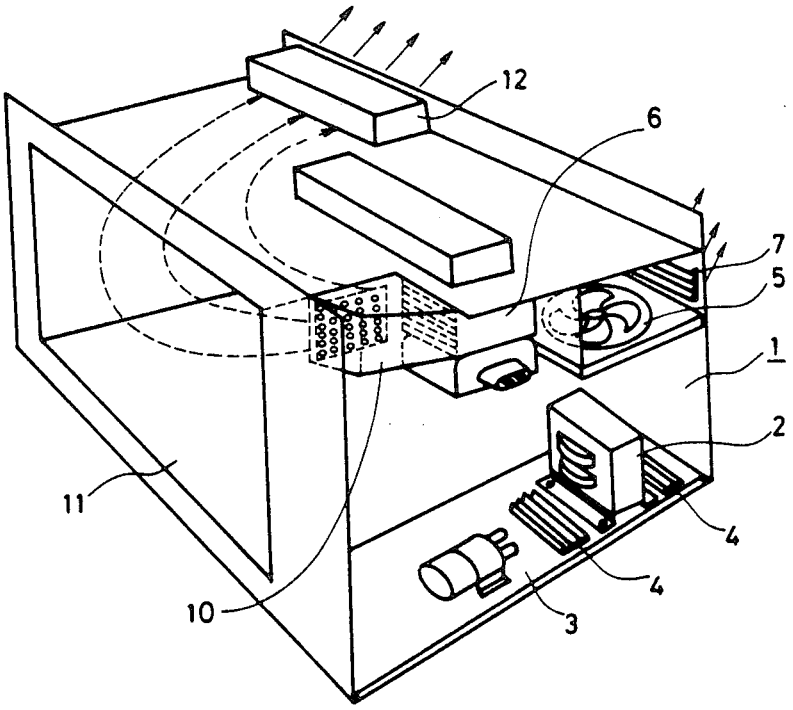
FIG. 2 is a perspective view of the high-frequency heater cooling device embodied by the present invention.

Referring now to the attached drawings, the preferred embodiment of the present invention is described below. FIG. 1 is a cross sectional view showing the high-frequency heater cooling device of a microwave oven reflecting the preferred embodiment of the present invention, while FIG. 2 is a perspective view of the high-frequency heater cooling device embodied by the present invention.

Figure 3:
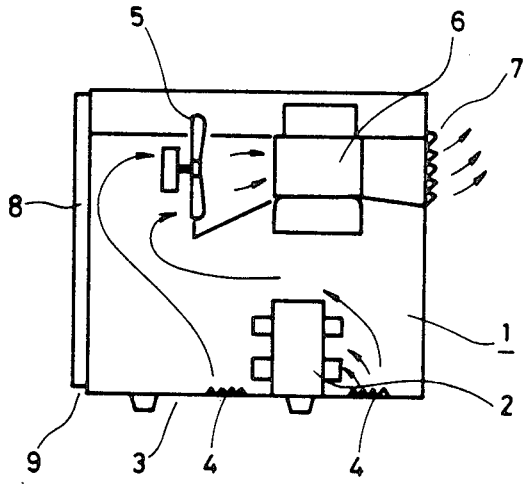
FIG. 3 is a cross sectional view of the high-frequency heater cooling device of a conventional microwave oven.

Note that the reference numbers respectively indicate such parts identical to those shown in FIG. 3. The preferred embodiment places the blower 5 in a position almost exactly above the high-voltage transformer 2 so that the incoming air can be fed upward vertically. The magnetron 6 and the exhaust outlet 7 are both aligned parallel to each other in the air path from the blower 5, thus allowing the magnetron 6 to be sufficiently cooled by a specific volume of incoming air before the remaining air is eventually discharged from the exhaust outlet 7. This configuration also allows residual air to be fed into the cooking chamber 11 via a duct 10 after cooling the magnetron 6, and then to be exhausted from the vapor duct 12. The air path formed for cooling these parts substantially minimizes the resistance factor throughout the entire passage, starting from the air-intake slits 4, via the blower 5 and up to the exhaust outlet 7, thus effectively improving the air transmission efficiency of the blower 5 and, in addition, increasing air flow, while such a configuration also causes the air flow to increase for cooling the high-voltage transformer 2. Since the incoming air from the air-intake slits 4 and 4 both in the front and rear parts of the high-voltage transformer 2 effectively cools it by completely surrounding it, the cooling effect of the high-voltage transformer sharply increases. It has been proved that, compared to cooling devices thus far made available for conventional microwave ovens, the new cooling system embodied by the present invention effectively constrains the coil temperature of the high-voltage transformer by about 20 deg., thus eventually making it possible to save appreciably on total costs through the reduction of the coil diameter of the high-voltage transformer 2. In addition to an axial-flow type blower 5 as shown in the attached drawings, any type of fan, for example, either a through-flow or centrifugal-type may be used.

The present invention is by no means limited by the description of the preferred embodiments and the attached drawings described above, but can be implemented in many variations within a range not deviating from the spirit and scope of the present invention. As is clear from the foregoing description, the microwave oven embodied by the present invention provides a unique system configuration to efficiently cool both the high-voltage transformer and the magnetron with a blower, in which the high-voltage transformer is secured to the air-intake port of the blower unit, while aligning both the magnetron and the exhaust outlet parallel to each other on the upper sides of the blower unit, thus effectively minimizing resistance to air ventilation through the blower unit, and, as a result, the operative efficiency of the blower unit and the actual cooling effect of the high-voltage transformer can be significantly improved. In addition, the embodiment of such a unique cooling system mentioned above eventually offers great advantages, with the possibility of saving on production costs through a reduction in coil diameter of the high-voltage transformer due to the improved temperature control of the coils of high-voltage transformers.

What is claimed is:

1. A cooling system for a microwave oven having a bottom wall, a top wall and side walls which comprises:

a transformer positioned on the bottom wall;

at least one air intake port provided in the bottom wall adjacent said transformer for receiving air from the atomsphere to cool said transformer;

a magnetron operatively mounted within said oven above said transformer;

an exhaust outlet provided on one of said walls adjacent said magnetron and aligned parallel to said magnetron; and a blower means disposed between said magnetron and said exhaust outlet for directing a portion of the air entering said air intake port through said exhaust outlet and directing the remaining portion of the air entering said air intake port across said magnetron to cool said magnetron.

2. The cooling system of claim 1 wherein said intake ports are disposed on both sides of said transformer.

3. The cooling system of claim 1 wherein a vapor duct is provided for exhausting the air passing over the magnetron.

* * * * *